United States Patent [19]

Partes

[11] 4,327,491

[45] May 4, 1982

[54] HOLDER FOR LEAD INSERT AND NEEDLE FOR A COMPASS

[75] Inventor: Günther Partes, Brunn, Fed. Rep. of Germany

[73] Assignee: Intertech Zeichengerate Genther Partes KG, Brunn, Fed. Rep. of Germany

[21] Appl. No.: 154,033

[22] Filed: May 28, 1980

[30] Foreign Application Priority Data

Jun. 7, 1979 [DE] Fed. Rep. of Germany ..... 2922999

[51] Int. Cl.[3] ..... B43L 9/24

[52] U.S. Cl. ..... 33/27 B; 33/152 B; 33/149 H

[58] Field of Search ..... 33/152, 149, 27 B

[56] References Cited

U.S. PATENT DOCUMENTS 1,284,372 11/1918 Lawrenz ..... 33/151
1,436,848 11/1922 Allie ..... 33/152 B
1,663,855 3/1928 O'Connor ..... 33/149 H

FOREIGN PATENT DOCUMENTS 503947 3/1920 France ..... 33/149 E
14406 of 1903 United Kingdom ..... 33/152 B

*Primary Examiner*—Harry N. Haroian
*Attorney, Agent, or Firm*—Holman & Stern

[57] ABSTRACT

An improved compass leg provided with a lower leg portion having an elongated cavity in which a pin or lead insert holder is received and secured by means of a threaded shaft attached to the holder and passing through an aperture in the lower leg portion and engaging a nut; the holder is provided with an axial hole to receive a substantial portion of the pin or lead insert and a groove which communicates with the axial hole such that tightening of the nut causes compression of the sides of the holder and maintains the pin or lead insert securely within the holder.

3 Claims, 4 Drawing Figures

HOLDER FOR LEAD INSERT AND NEEDLE FOR A COMPASS

BACKGROUND OF THE INVENTION

1. Field Of The Invention

The present invention concerns a holder for a lead insert and a pin in a compass which is provided with a holder piece having a receiving member positioned in a cavity of the lower end portion of the flange, into which the lead insert or the needle can be arranged and tightened by means of a locknut, whereby the holder piece is provided with a groove extending into the receiving member which forms a channel nearly totally enveloping the lead insert or needle.

2. Description Of The Prior Art

German Utility Model No. 675570 discloses a holder for a lead insert and a needle which is open towards the base of the cavity of the lower end of the flange; during the tightening of the locknut resting on a threaded journal which sits somewhat in the central portion of the holder and which penetrates the base of the groove, the lead insert or needle is tightened between the rear wall of the holder borehole and the inner surface of the base of the groove. This structure has proven itself to be disadvantageous in many respects.

Thus, during the tightening of the locknut, there develops a bending of the holder in its center area, whereby the lead insert is also subjected to the bending. If this bending becomes too extensive, then the lead insert will break; however, when the locknut, in order to prevent such a stressing, is not pulled tight enough, then the lead insert is insufficiently secured and will fall out of the holder at the first chance. A secure clamping of the lead insert without dammaging the same is thus very difficult to obtain.

A further disadvantage is seen in the fact that, when the lead insert, due to useage, has sunk down below the threaded journal, the block, which supports itself in the upper area of the holder against the inner surface of the base of the groove, is missing. This leads to a tilting of the holder, and in such a manner that the lower end portion of the lead insert contacting the drafting paper is inwardly tiltable in the direction of the longitudinal center axis of the compass; there exists therefore the danger that the lead insert will rock or shake when in use.

Finally, it is a disadvantage that the borehole of the holder must be adapted to the largest-possible diameter of lead inserts or needles, since the borehole is not adjustable; this then results in a comparatively large play of the lead inserts or needles in the borehole when leads or needles with a fine crosscut have to be used. In such cases, there exists only a very unstable dual-line positioning of the lead inserts or needles.

German published Specification No. 19 03 653 discloses a needle-holder which is pivotably positioned at the lower fork-shaped end of a compass flange, wherein said holder is provided with a holding element having a receiver or borehole enveloping the needle almost entirely. The holder piece is provided with a longitudinal slot extending into the borehole and enabling the altering of the borehole crosscut and thereby its adaptation to different diameters of the needles; the plane of the slot forms a right angle with the axis of the threaded journal of the locknut.

Since the holding piece in this prior art structure—different than in the above-described holder in which the receiving of the lead insert or needle represents a groove enveloping the latter only partially—is provided with a channel enveloping the lead insert or needle almost entirely, there exists a planar contact between the lead insert or the needle on one hand and the holder piece on the other hand, which produces a favorable pressure distribution. Notwithstanding the fact that this prior art structure is suitable for receiving needles only, it, too, has not provided a solution to the existing needs.

Thus, it has proven a substantial disadvantage that an effective clamping of the needle in the borehole is obtainable only in that area of the holder piece where it is located between the flange fork formed at the lower end portion of the compass leg. Every place where the holder piece protrudes between these forked flanges, the tightening of the needle is reduced, so that there is obtained a variably strong tightening over the length of the holder piece. In the most unfavorable case, only that area which is adjacent the axial borehole receiving the threaded journal of the locknut is correctly tightened.

SUMMARY OF THE INVENTION

It is the object of the instant invention to provide for a holder for compasses which is equally suitable to receive lead inserts or needles and which tightens lead inserts or needles of varying cross-section in a safe and secure manner evenly over their entire length, but without the danger of breaking or bending same. Based on the above-described prior art holders, this problem is inventively solved in that the lateral walls of the groove which between themselves envelope the holder piece, are provided with a cavity which is reducing in the tightening direction of the locknut, and the groove is arranged on the side of the holder piece which faces away from the locknut.

On the basis of this structure, the cross-section of the holder piece and especially the cross-section of the lead and needle channel can be evenly altered within wide limits, but always over its entire length. These changes in the cross-section are solved by means of the taper of the lateral walls of the cavity. During the tightening of the locknut, the holder piece is pulled into the cavity in the direction of the base of the latter, whereby, due to the reduction of the distance between the lateral walls, the holder piece is compressed and its cross-section as well as the cross-section of the channel for the lead insert and the needle is adjusted in such a manner so that there develops a tightening or clamping of the lead insert or needle which is even over their entire circumference. A tilting of the holder piece, after the lead is partially used up, does not occur.

In a further embodiment of the present invention, the taper remains the same over the entire length of the lateral walls of the cavity.

It may be of an advantage, however, in case where, for example, possible bending of the holder piece should appear in the area of the threaded journal during the tightening of the locknut, to select a steeper taper in the area of the threaded journal than in the other areas in order to counteract the forward-slipping of this area of the holder piece during the tightening of the locknut.

It has been proven advantageous when the longitudinal flanges of the holder piece which abut the lateral walls of the cavity are provided with a tapering corresponding to the taper of the lateral walls. Of course, the longitudinal flanges of the holder piece may also be concavely curved so that there results an annular, elliptical or similar contour of the cross-section.

The drawing shows a preferred embodiment of the present invention, whereby

Figure 1:
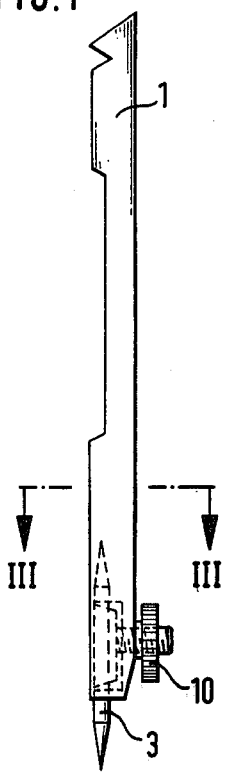
FIG. 1 shows a compass leg with a mounted holder for a lead insert and a needle.
Figure 2:
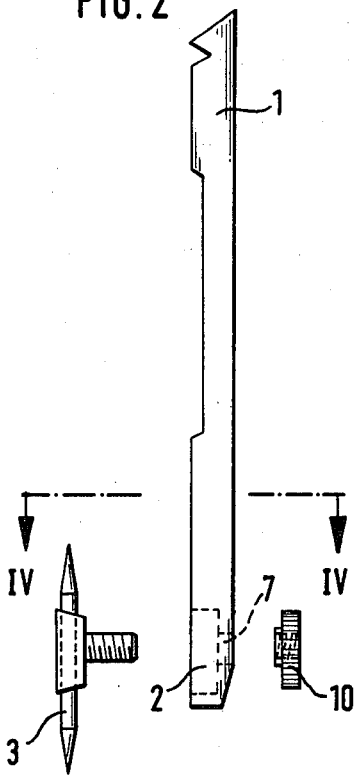
FIG. 2 shows the compass leg of FIG. 1 with an expanded view of its individual component parts.
Figure 2:
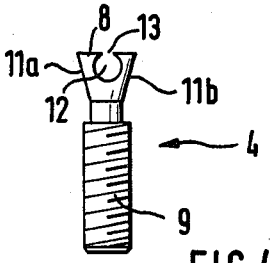
Figure 3:
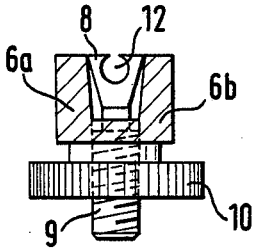
FIG. 3 shows a cross-sectional view according to Line III—III of FIG. 1 without the lead insert, in an enlarged dimension.
Figure 4:
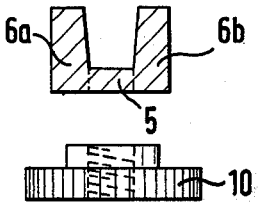
FIG. 4 shows a cross-sectional view according to Line IV—IV of FIG. 2 without the lead insert in an enlarged dimension.

FIGS. 1 and 2 illustrate a compass flange 1 having a cavity 2 provided at its lower end portion, designed for receiving a holder piece 4 which holds the lead insert or needle 3. The structure of cavity 2 and the holder piece 4 is recognized most of all in FIG. 4.

The cavity 2 is enveloped by a base 5 placed in the outwardly-directed flange side as well as by the lateral walls 6*a* and 6*b* which abut in a flanged manner their lateral edges, and which are located in the forward- or rearward-directed sides of the flange. On the inwardly-directed flange sides opposite the base 5 and at the end of the flange, the cavity 2 is open. A passage 7 is provided in the center area of base 5.

The lateral walls 6*a* and 6*b* are provided with a tapered design at their inner surface area in a manner so that the width of cavity 2 reduces evenly in the direction of base 5. This taper does not have to be even; it may change over the length of cavity 2, or it may be different at the lateral wall 6*a* from that at the lateral wall 6*b*.

The holder piece 4 comprises a taper part 8 to which abuts a threaded journal 9 about centrally at a right angle, which, when the holder piece 4 is inserted into the cavity 2, penetrates the passage 7, and extends laterally outwards beyond the flange of the compass; a locknut 10 can be screwed onto this protruding area of the threaded journal 9.

The tubular part 8 in the illustrated embodiment has a trapezoidal cross section, whereby the taper of the longitudinal flanges 6*a* and 6*b* which contact the lateral walls 11*a* and 11*b* in view of the taper of lateral walls 6*a* and 6*b* are equal but flatter than these walls. In the direction of its longitudinal axis, the tapered part 8 is penetrated by a lead insert and needle channel 12 which is provided with a circular cross section.

The lead insert 3 and needle channel 12 is open over the entire length of tapered part 8 on the side facing away from the locknut 10 by means of a groove 13. It is however also feasible to allow the groove 13 to engage only a portion of the holder piece 4, especially its lower half portion; additionally, the groove 13 could be placed on that side of the now closed lead insert and needle channel 12 which is facing towards the locknut 10, or, as shown in the drawing, additionally be also continued on the opposite side of the lead insert and needle channel 12 which faces the locknut 10.

The inventive lead insert and needle holder is thus suitable for use in connection with compass inserts.

What I claim is:

1. In a compass leg having a lower leg portion with a means for holding a pin or marking insert, the improvement comprising: said lower leg portion having an elongated rectangular cavity with a first trapezoidal cross-section as determined by a plane passing through said leg at approximately a right angle with respect to the longitudinal axis of said leg, said cavity located in a lower portion of said leg and having an elongated opening formed in the side forming the base of said first trapezoidal cross-section, a first aperture formed in the wall opposite said opening and communicating with said cavity, and a second aperture formed in the bottom of said leg and communicating with said cavity; said holding means being commensurate in shape with and placed within said elongated cavity, said holding means being elongated and having a second trapezoidal cross-section as determined by a plane passing through said holding means at approximately a right angle with respect to the longitudinal axis of said holding means and an axial hole for receiving said pin or insert, the hole disposed such that the hold forms an axial slot in the side forming the base of the second trapezoidal cross-section, and a threaded shaft perpendicular to and attached to the side of said holding means opposite the side having a slot therein, said shaft projecting through said first aperture in said elongated cavity; and a nut engaging said threaded shaft and securing said elongated holding means with said elongated cavity, such that when said nut is tightened around said shaft, contact between the non-parallel sides forming the first trapezoidal cross-section and the non-parallel sides forming the second trapezoidal cross-section results in uniform compression of the non-parallel sides forming the second trapezoidal cross-section of said elongated holding means and clamping of said holding means around a substantial portion of the surface of the pin or marking insert.

2. The device of claim 1, wherein the angle formed by the non-parallel sides forming the first trapezoidal cross-section is approximately equal to the angle formed by the non-parallel sides forming the second trapezoidal cross-section.

3. The device of claim 1, wherein the angle formed by the non-parallel sides forming the first trapezoidal cross-section is smaller than the angle formed by the non-parallel sides forming the second trapezoidal cross-section.

* * * * *